US010651605B2

(12) United States Patent
Zhao et al.

(10) Patent No.: US 10,651,605 B2
(45) Date of Patent: May 12, 2020

(54) ELECTRICAL CONNECTOR HAVING AN IMPROVED ISOLATIVE BLOCK

(71) Applicants: FUYU ELECTRONICAL TECHNOLOGY (HUAIAN) CO., LTD., Huai'an (CN); FOXCONN INTERCONNECT TECHNOLOGY LIMITED, Grand Cayman (KY)

(72) Inventors: Jun Zhao, Huaian (CN); Cai-Yun Zhang, Huaian (CN)

(73) Assignees: FUYU ELECTRONICAL TECHNOLOGY (HUAIAN) CO., Huai'an (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/175,779

(22) Filed: Oct. 30, 2018

(65) Prior Publication Data

US 2019/0131745 A1 May 2, 2019

(30) Foreign Application Priority Data

Oct. 30, 2017 (CN) ..... 2017 2 1417535 U

(51) Int. Cl.

| | |
|---|---|
| ***H01R 13/6585*** | (2011.01) |
| ***H01R 13/6591*** | (2011.01) |
| ***H01R 13/40*** | (2006.01) |
| ***H01R 13/405*** | (2006.01) |
| ***H01R 24/60*** | (2011.01) |
| ***H01R 107/00*** | (2006.01) |

(52) U.S. Cl.
CPC ..... *H01R 13/6585* (2013.01); *H01R 13/40* (2013.01); *H01R 13/405* (2013.01); *H01R 13/6591* (2013.01); *H01R 24/60* (2013.01); *H01R 2107/00* (2013.01)

(58) Field of Classification Search
None
See application file for complete search history.

(56) References Cited

U.S. PATENT DOCUMENTS

| | | | | |
|---|---|---|---|---|
| 10,218,134 | B2 * | 2/2019 | Tsai | H01R 13/6585 |
| 2014/0087575 | A1 * | 3/2014 | Pichot | H01R 13/527 439/271 |
| 2015/0194770 | A1 * | 7/2015 | Little | H01R 13/6582 439/607.27 |
| 2015/0200504 | A1 * | 7/2015 | Little | H01R 24/60 439/345 |

(Continued)

FOREIGN PATENT DOCUMENTS

| | | |
|---|---|---|
| CN | 106129688 | 11/2016 |
| CN | 106159522 | 11/2016 |

(Continued)

*Primary Examiner* — Edwin A. Leon
*Assistant Examiner* — Oscar C Jimenez
(74) *Attorney, Agent, or Firm* — Wei Te Chung; Ming Chieh Chang

(57) ABSTRACT

An electrical connector includes an insulative housing, a number of conductive terminals affixed to the insulative housing, a shielding plate affixed to the insulative housing, a shielding shell enclosing the insulative housing, and an isolative block isolating the conductive terminals from the shielding plate.

17 Claims, 10 Drawing Sheets

(56) References Cited

U.S. PATENT DOCUMENTS

| | | | | |
|---|---|---|---|---|
| 2016/0049756 | A1* | 2/2016 | Yen | H01R 13/6585 439/676 |
| 2017/0324188 | A1* | 11/2017 | Guo | H01R 13/405 |
| 2017/0346232 | A1* | 11/2017 | Zhao | H01R 24/60 |
| 2019/0052024 | A1* | 2/2019 | Zhao | H01R 13/6585 |

FOREIGN PATENT DOCUMENTS

| | | |
|---|---|---|
| CN | 205921159 | 2/2017 |
| CN | 107658618 | 2/2018 |

* cited by examiner

ELECTRICAL CONNECTOR HAVING AN IMPROVED ISOLATIVE BLOCK

BACKGROUND OF THE DISCLOSURE

1. Field of the Disclosure

The present disclosure relates to an electrical connector, and more particularly to an electrical connector which can achieve electromagnetic shielding and avoid fire risk.

2. Description of Related Arts

China Patent No. 205921159 discloses an electrical connector including a row of upper terminals, a row of lower terminals and a shielding plate sandwiched between the upper terminals and lower terminals. A respective insulative layer is applied to corresponding surfaces of the upper terminals and the lower terminals facing the shielding plate.

China Patent No. 106129688 discloses an electrical connector replacing the above insulative layers by ceramic materials. Due to the high sintering temperature of the ceramic, the risk of melting the plastic when the conductive terminal is at high temperature high is avoided.

SUMMARY OF THE DISCLOSURE

Accordingly, an object of the present disclosure is to provide an electrical connector which can achieve electromagnetic shielding and avoid fire risk.

To achieve the above object, an electrical connector comprises: an insulative housing including a base portion and a tongue portion extending forwardly from the base portion; a plurality of conductive terminals affixed to the insulative housing and including a row of upper terminals and row of lower terminals, each terminal having a contacting portion exposed to the tongue portion; a shielding plate sandwiched between the upper terminals and the lower terminals; a shielding shell enclosing the insulative housing; and an isolative block isolating the conductive terminals from the shielding plate.

DETAILED DESCRIPTION OF THE PREFERRED EMBODIMENT

Figure 1:
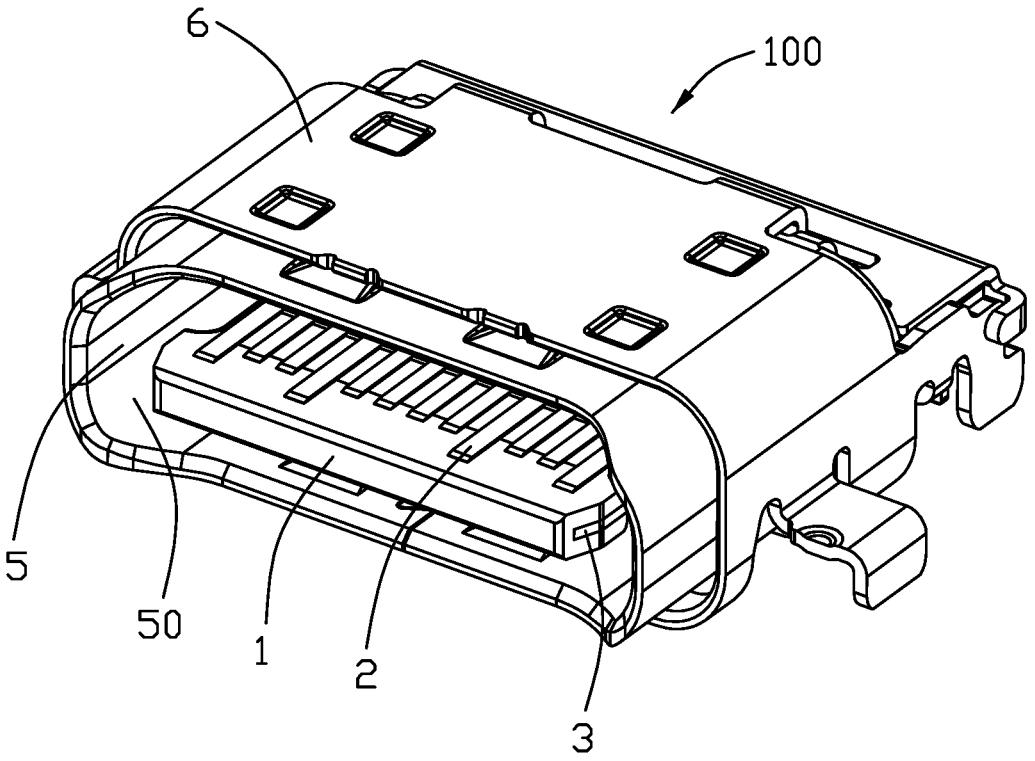
FIG. 1 is a perspective, assembled view of an electrical connector.
Figure 2:
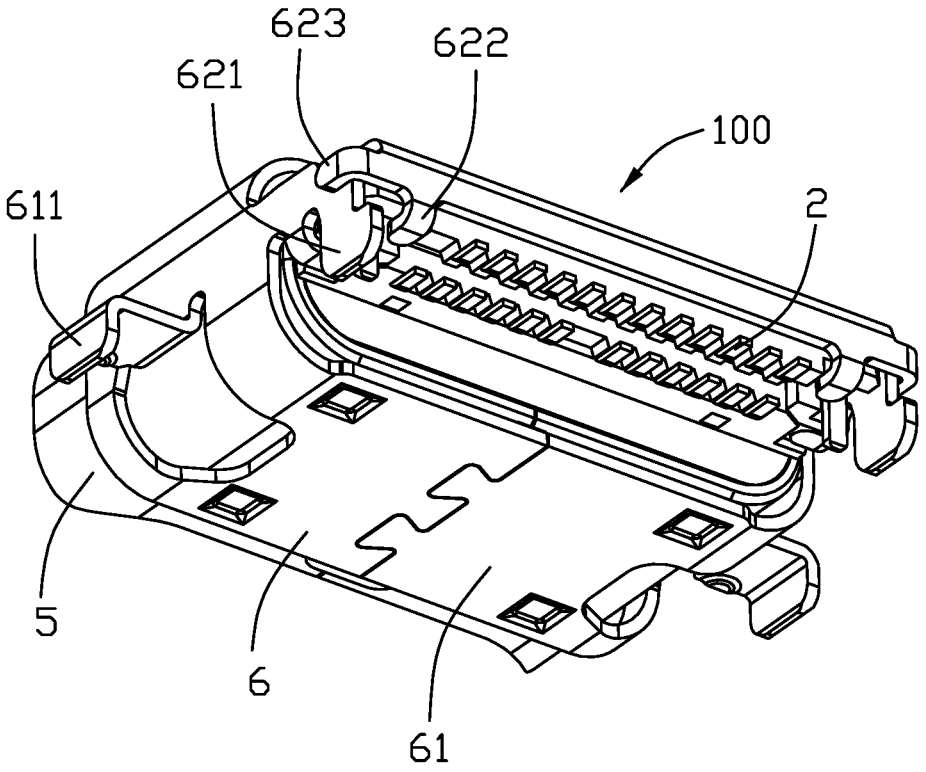
FIG. 2 is another assembled view of the electrical connector taken from FIG. 1.
Figure 3:
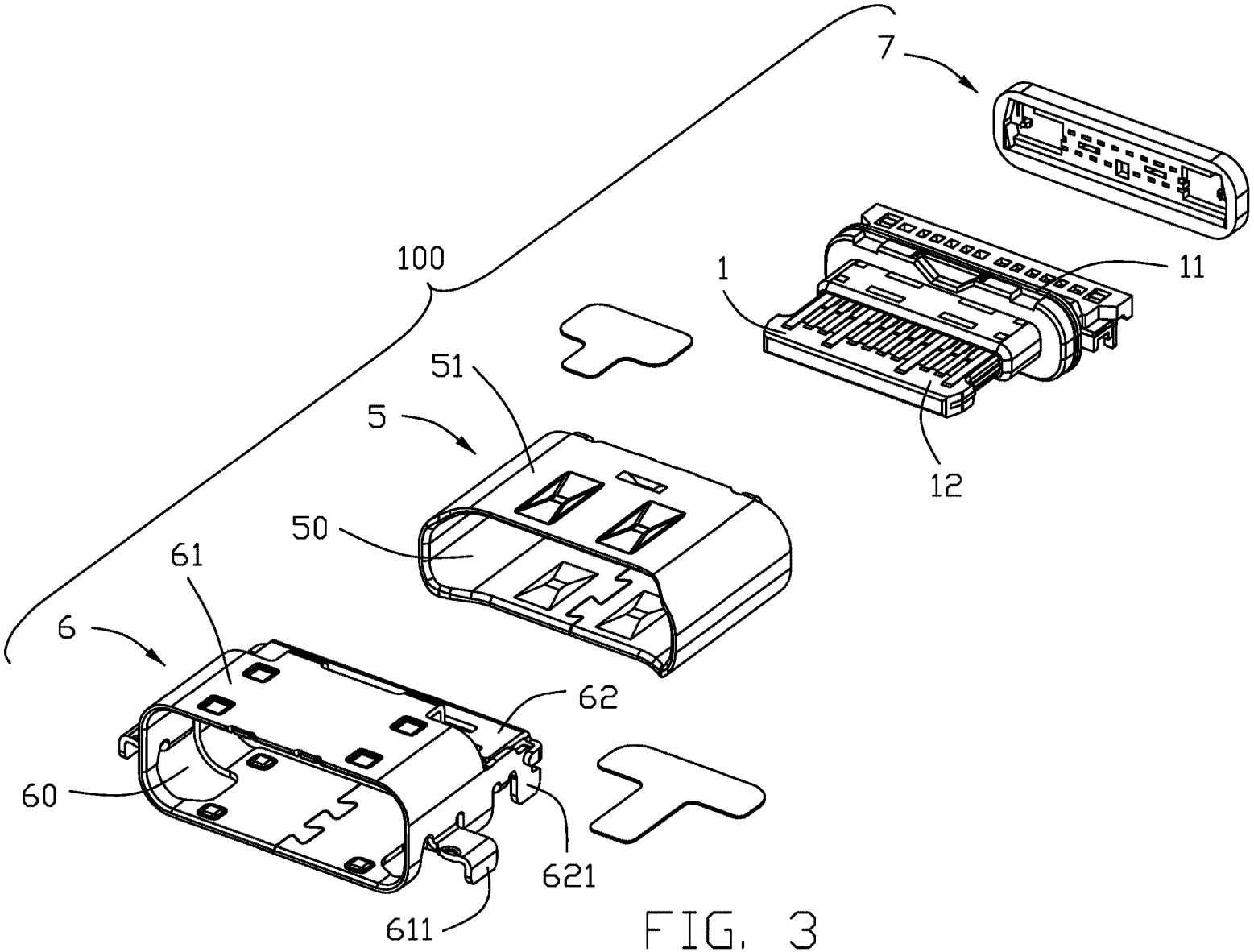
FIG. 3 is an exploded view of the electrical connector.
Figure 4:
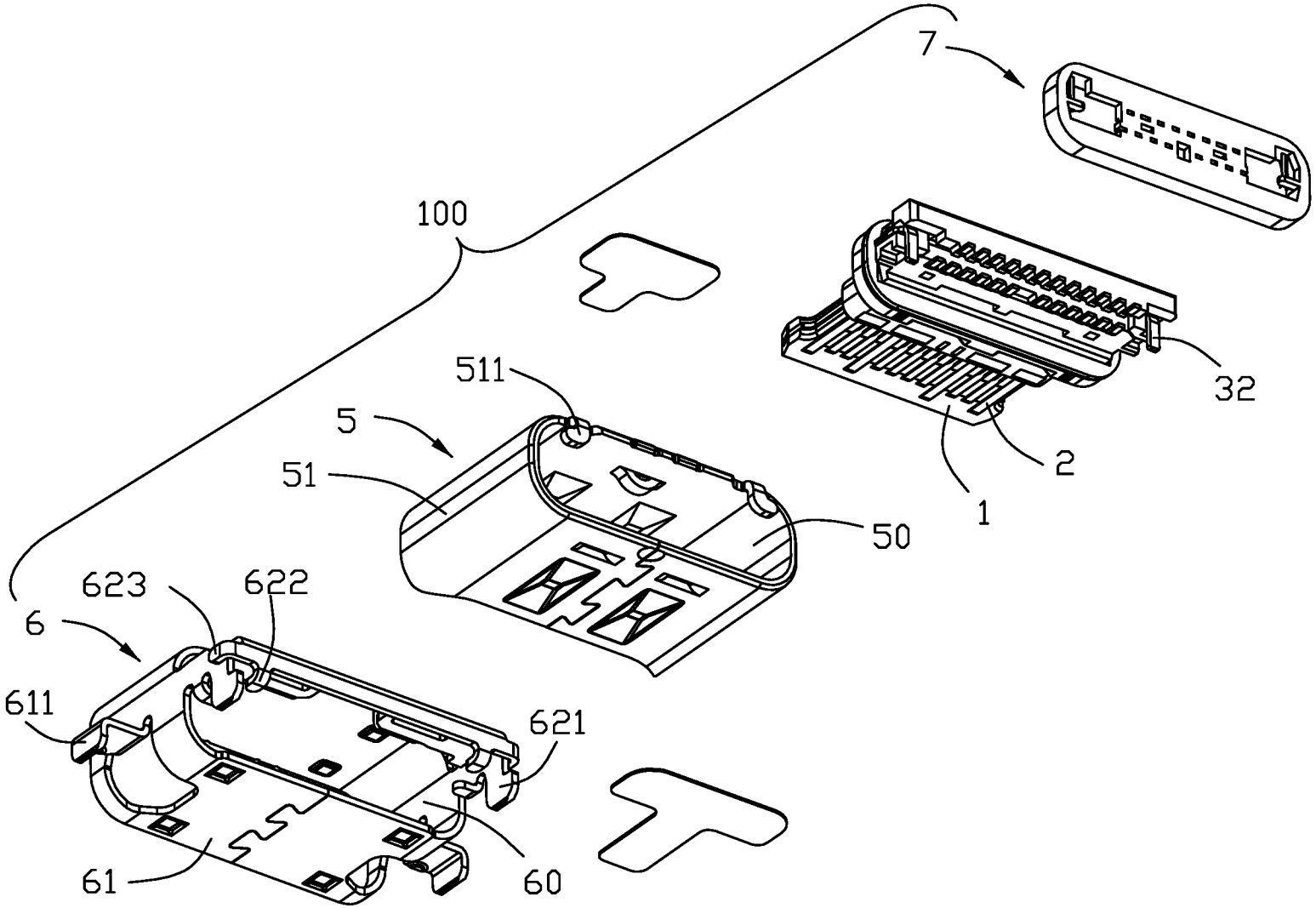
FIG. 4 is another exploded view of the electrical connector taken from FIG. 3.
Figure 5:
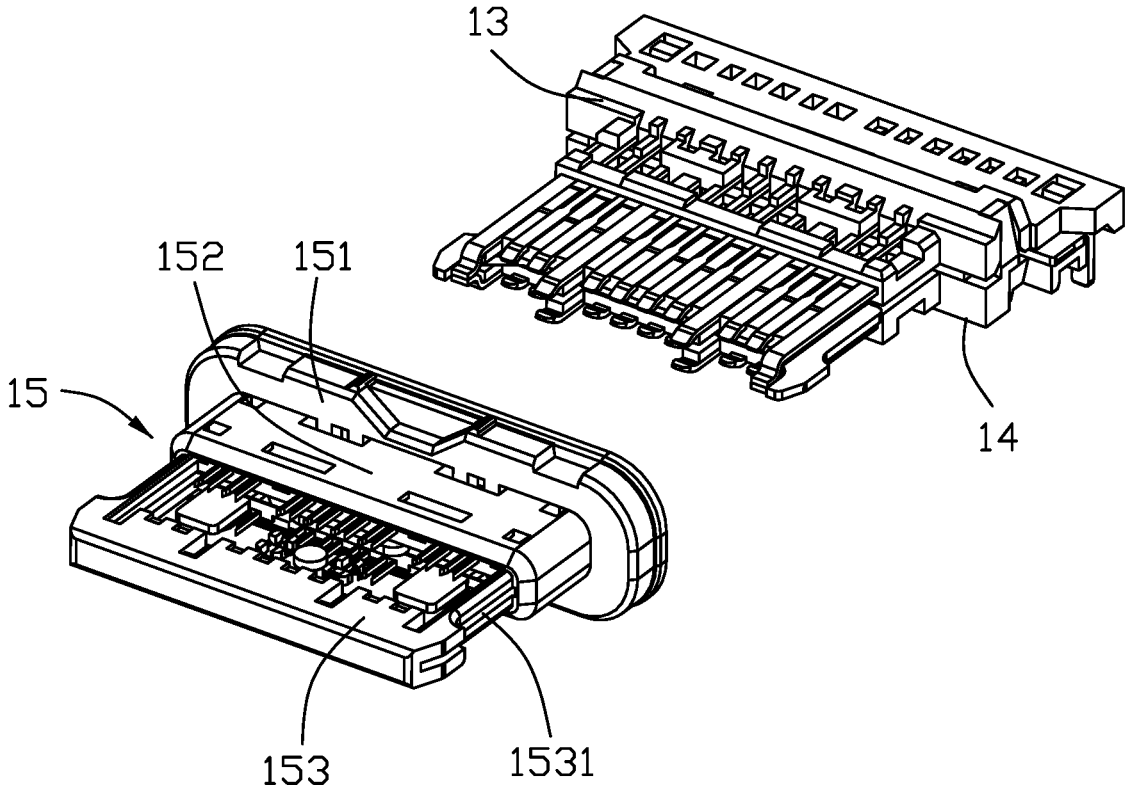
FIG. 5 is a partial exploded view of a contact module of the electrical connector.
Figure 6:
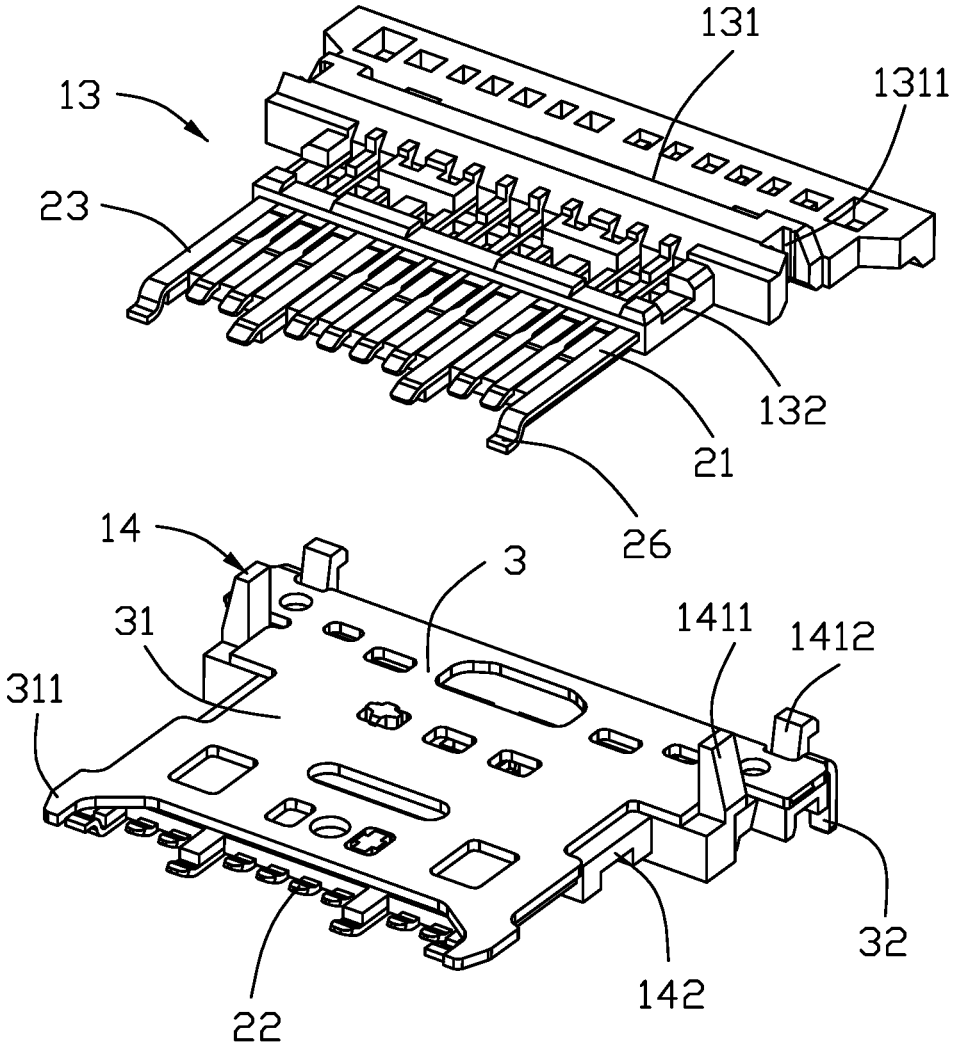
FIG. 6 is an exploded view of an upper contact module and a lower contact module of the electrical connector.
Figure 7:
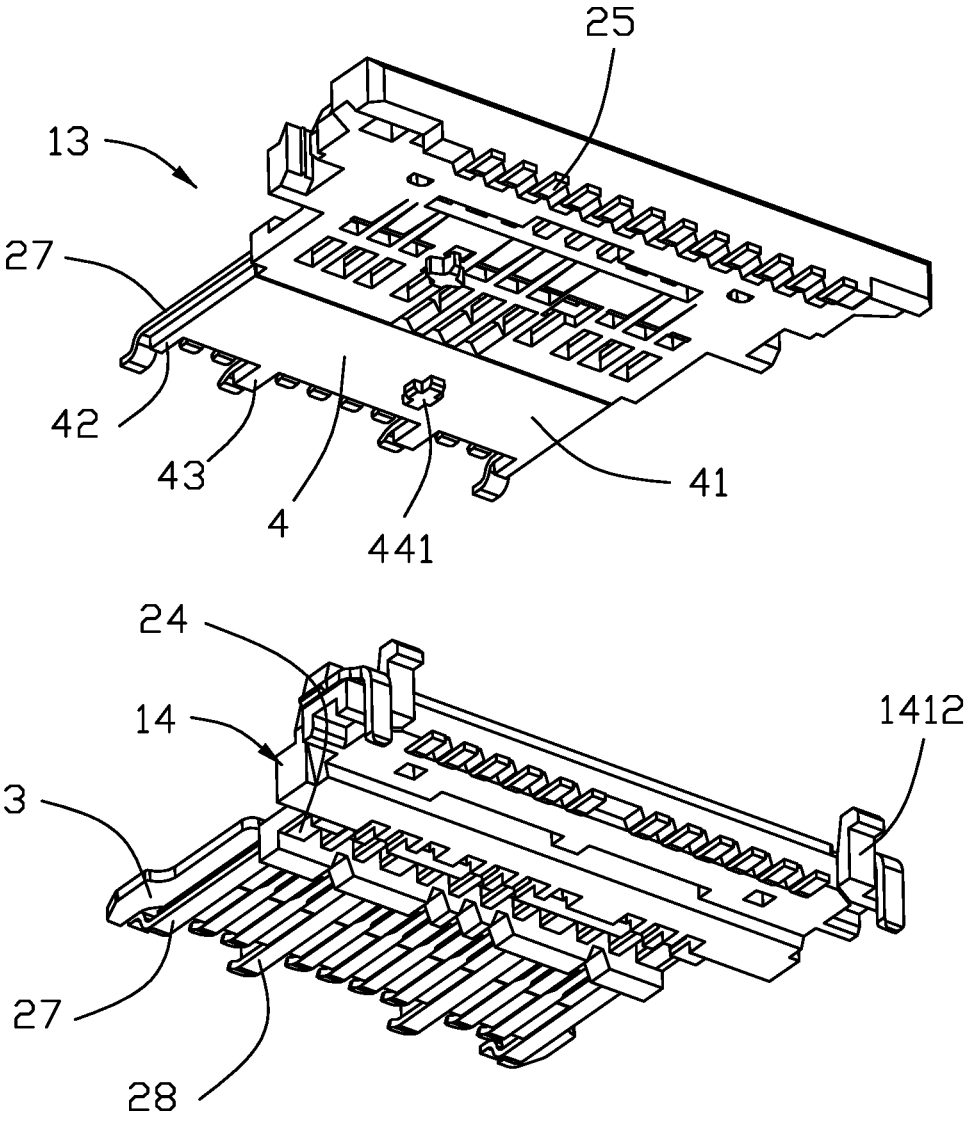
FIG. 7 is another exploded view taken from FIG. 6.
Figure 8:
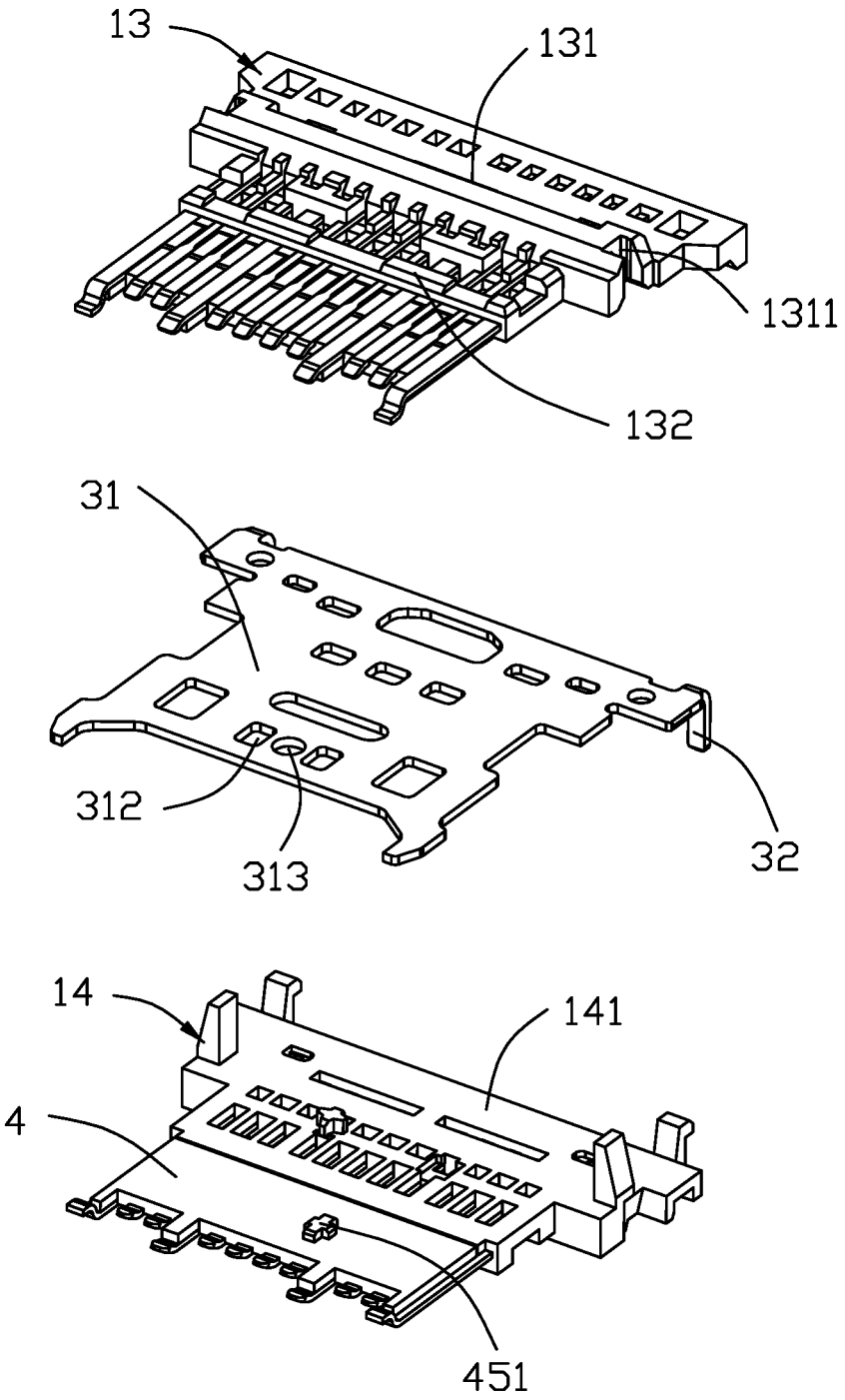
FIG. 8 is an exploded view of the upper contact module, the lower contact module and a shielding shell of the electrical connector.

Reference will now be made in detail to the embodiments of the present disclosure.

Referring to FIGS. 1 to 10, the electrical connector 100 includes an insulative housing 1, a number of conductive terminals 2 affixed to the insulative housing 1 and arranged in upper terminals 21 and lower terminals 22, a shielding plate 3 sandwiched between the upper terminals 21 and the lower terminals 22, an isolative/insulative block 4 isolating the shielding plate 3 from the conductive terminals 2, a shielding shell 5 enclosing the insulative housing 1 for forming a receiving room 50, a metal shell 6 enclosing the shielding shell 5 and having a cavity 60, and a sealer 7 sealing a rear end of the electrical connector 100.

Referring to FIGS. 3 to 10, the insulative housing 1 includes a base portion 11 and a tongue portion 12 extending forwardly from the base portion 11. The insulative housing 1 includes a first/upper insulator 13, a second/lower insulator 14 opposite to the first insulator 13 and a third/final insulator 15 enclosing the first insulator 13 and the second insulator 14. Referring to FIGS. 6 to 10, the first insulator 13 includes a first base 131 and a first stepped portion 132 extending forwardly from the first base 131. The first base 131 includes a pair of notches 1311 in a transverse direction and a rear barrier 1312 located at a rear end thereof. The second insulator 14 includes a second base 141 and a second stepped portion 142 extending forwardly from the second base 141. The second base 141 includes a pair of protrusions 1411 latched with the notches 1311 in the transverse direction and a pillar 1412 resisting forwardly against the rear barrier 1312. The third insulator 15 includes a third base 151, a third stepped portion 152 extending forwardly from the third base 151, and a tongue 153 enclosing the front ends of the conductive terminals 2 for forming the tongue portion 12. The tongue 153 includes a pair of mating grooves 1531 located laterally and mated with a corresponding electrical connector. The base portion 11 is composed of first base 131, the second base 141 and the third base 151.

Referring to FIGS. 4 to 7, the conductive terminals 2 includes the upper terminals 21 and the lower terminals 22. Notably, the upper terminals 21 are integrally formed within the first insulator 13 to commonly form an upper/first contact module, and the lower terminals 22 are integrally formed within the second insulator 14 to commonly form a lower/second contact module. Each conductive terminal 2 includes a connecting portion 24 affixed to the base portion, a contacting portion 23 extending forwardly from the connecting portion 24 and exposed to the tongue portion 12, an embedded portion 26 bending downwardly from the contacting portion 23 and then extending forwardly to be embedded in the tongue portion 12, and a soldering portion 25 extending rearward from the connecting portion 24. Each row of conductive terminals includes signal terminals, a pair of ground terminals 27 located at outermost side, and a pair of power terminals 28 located inside the ground terminals 27 and isolated two terminal positions from the ground terminals 27. The ground terminals 27 and the power terminals 28 extend forwardly from other signal terminals.

Referring to FIGS. 7 to 10, the shielding plate 3 includes a main portion 31 and a pair of soldering pins 32 bending downwardly from a rear end of the main portion 31. The main portion 31 includes a pair of protruding portions 311 extending laterally, a first positioning hole 312 and a second positioning hole in symmetry with each other and located at a front end thereof. The protruding portions 311 are exposed to the mating grooves 153 and contact with the corresponding electrical connector.

Figure 9:
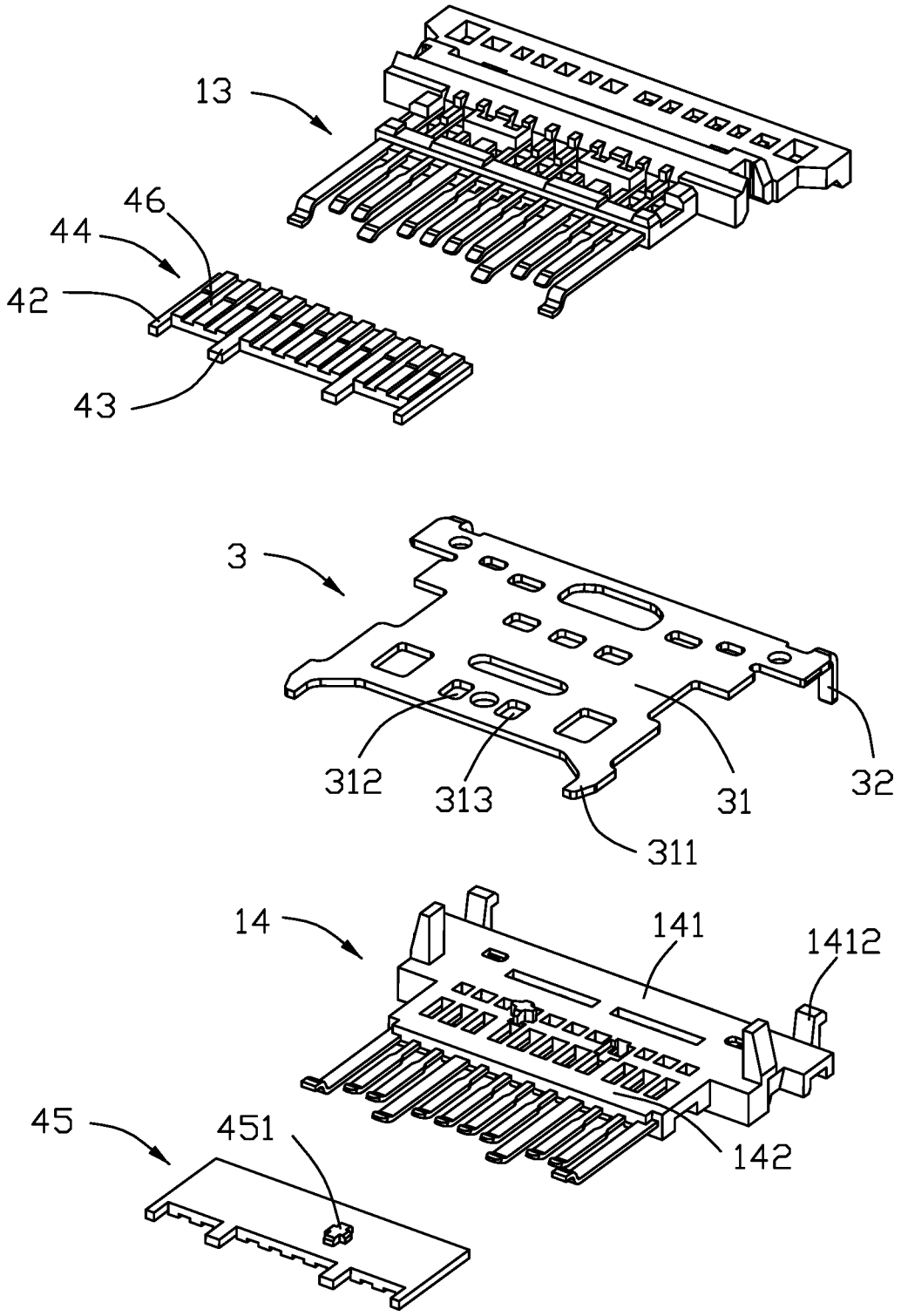
FIG. 9 is an exploded view of the contact module of the electrical connector.
Figure 10:
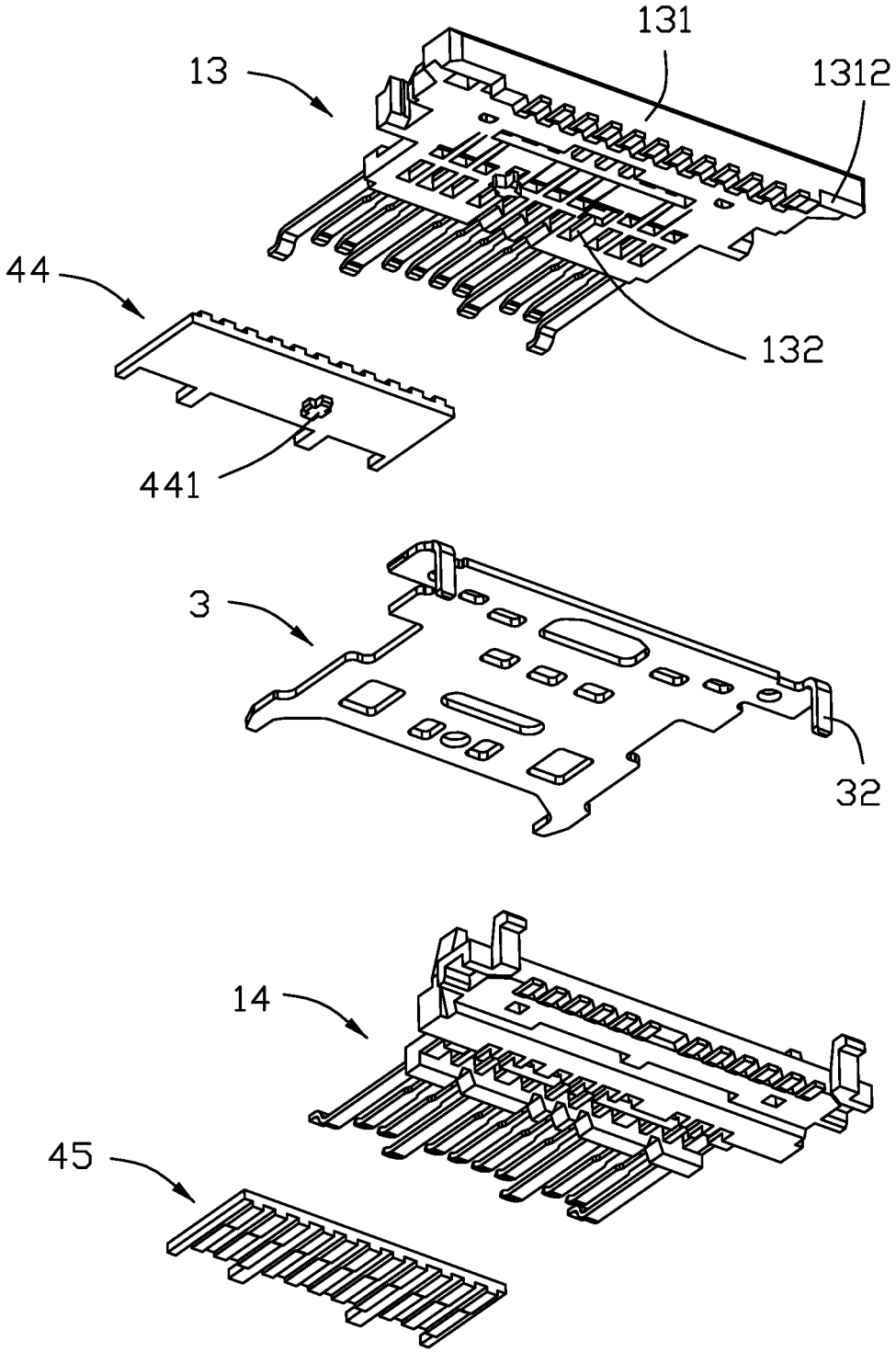
FIG. 10 is another exploded view taken from FIG. 9.

Referring to FIGS. 9 to 10, the isolative block 4 is sandwiched between the shielding plate 3 and the contacting portions 23 of the conductive terminals 2. The isolative block 4 is affixed to the shielding plate 3. The isolative block 4 includes a main board 41, a first tuber 42 extending forwardly from a front end of the main board 41 and a second tuber 43 located inside the first tuber 42. The isolative block 4 further includes a number of positioning grooves 46 corresponding to the contacting portions 23 of the conductive terminals 2. The first tuber 42 isolates a front end of each ground terminal 27 of the upper terminals 21 from a front end of each ground terminal 27 of the lower terminals 22. The second tuber 43 isolates a front end of each power terminal 28 of the upper terminals 21 from a front end of each power terminal 28 of the lower terminals 22. In other embodiments, the isolative block 4 may be provided as an integral U-shaped shape, and insert into the shielding plate 3 in a rear-to-front direction. The isolative block 4 includes a fixing post penetrating the shielding plate 3. In the preferred embodiment, the isolative block 4 includes a first isolative plate 44 isolating the upper terminals 21 from the shielding plate 3 and a second isolative plate 45 isolating the lower terminals 22 from the shielding plate 3. The shielding plate 3 is sandwiched between the first isolative plate 44 and the second isolative plate 45. The first isolative plate 44 includes a first positioning pillar 441 latched with the first positioning hole 312 and located at a surface matched with the shielding plate 3. The second isolative plate 45 includes a second positioning pillar 451 latched with the second positioning hole 313 and located at a surface matched with the shielding plate 3. The shielding plate 3 is sandwiched between the first isolative plate 44 and the second isolative plate 45. A rear end of the first isolative plate 44 resists against a front end of the first stepped portion 132. A rear end of the second isolative plate 45 resists against a front end of the second stepped portion 142. The third insulator 15 is integrated with the isolative block 4. The first positioning pillar 441 and the second positioning pillar 451 are in symmetry with each other in the transverse direction. The first positioning pillar 441 and the second positioning pillar 451 are locked in main portion 31.

Referring to FIGS. 1 to 4, the shielding shell 5 includes a receiving room 50 receiving the insulative housing 1 and a cylindrical main portion 51. The cylindrical main portion 51 includes a pair of resisting portion 511 resisting against the rear barrier 1312 and bending downwardly from a rear end of a top wall of the cylindrical main portion 51.

Referring to FIGS. 1 to 4, the metal shell 6 includes a cavity 60 receiving the shielding shell 5, a cylindrical part 61 forming the cavity 60, and a covering portion 62 bending downwardly and rearward from a rear end of the cylindrical part 61. The cylindrical part 61 includes a pair of first fixed portions 611 tearing apart and extending laterally to be fixed with a printed circuit board. The covering portion 62 includes a pair of second fixed portions 621 bending downwardly, a pair of first latching portions 622 bending rearward and latched with a bottom surface of the base portion 11, and a pair of second latching portions 623 bending forwardly and latched with the second fixed portions 621.

Compared with the prior art, the electrical connector 100 takes advantage of the isolative block 4 to isolate the conductive terminals 2 from the shielding plate 3 avoiding fire attacking caused by short circuit contacting. Understandably, the isolative block 4 should be stiffer/harder than the insulative housing and endure the higher melting temperature for enhancement of the tongue portion mechanically and electrically with a lower risk of shorting. In this embodiment, the isolative block is ceramic while the insulative housing is plastic.

While the preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing including a base portion and a tongue portion extending forwardly from the base portion;

a plurality of conductive terminals affixed to the insulative housing and including a row of upper terminals and a row of lower terminals, each terminal having a contacting portion exposed to the tongue portion;

a shielding plate sandwiched between the upper terminals and the lower terminals;

a shielding shell enclosing the insulative housing; and an insulative isolative block isolating the conductive terminals from the shielding plate; wherein the isolative block comprises a first isolative plate isolating the upper terminals from the shielding plate and a second isolative plate isolating the lower terminals from the shielding plate;

the insulative housing comprises a first insulator affixing with the upper terminals, a second insulator affixing with the lower terminals, and a third insulator enclosing the first insulator and the second insulator, the first insulator comprises a first base and a first stepped portion extending forwardly from the first base, the second insulator comprises a second base and a second stepped portion extending forwardly from the second base, and the third insulator comprises a third base enclosing the first base and the second base, a third stepped portion enclosing the first stepped portion and the second stepped portion, and a tongue affixing with the contacting portions to form the tongue portion; and a rear end of the first isolative plate resists against a front end of the first stepped portion, and a rear end of the second isolative plate resists against a front end of the second stepped portion.

2. The electrical connector as claimed in claim 1, wherein the isolative block comprises a plurality of positioning grooves affixing the contacting portions and corresponding to the contacting portions of the upper terminals and lower terminals.

3. The electrical connector as claimed in claim 2, wherein the isolative block is affixed to the shielding plate.

4. The electrical connector as claimed in claim 2, wherein the first isolative plate comprises a first positioning pillar located at a surface the first isolative plate mated with the shielding plate, the second isolative plate comprises a second positioning pillar located at a surface the second isolative plate mated with the shielding plate, and the shielding plate comprises a first positioning hole mated with the first positioning pillar and a second positioning hole mated with the second positioning pillar.

5. The electrical connector as claimed in claim 4, wherein the shielding plate is sandwiched between the first isolative plate and the second isolative plate in a vertical direction.

6. The electrical connector as claimed in claim 1, wherein each row of terminals comprise plural signal terminals, a pair of ground terminals located at an outermost side, and a pair of power terminals located inwardly of the ground terminals and spaced two terminal positions from the ground terminals, and a front end of the ground terminal and a front end of the power terminal extend forwardly from a front end of the plural signal terminals; wherein the isolative block comprises a main board, a first tuber extending forwardly from the main board and a second tuber extending forwardly from the main board, the first tuber is sandwiched between the front ends of the ground terminals of the upper terminals and the front ends of the ground terminals of the lower terminals, and the second tuber is sandwiched between the front ends of the power terminals of the upper terminals and the front ends of the power terminals of the lower terminals.

7. An electrical connector comprising:

a first contact module including a plurality of upper contacts integrally formed within an upper insulator, each of said upper contacts including a contacting portion exposed outside of the upper insulator in a front-to-back direction;

a second contact module including a plurality of lower contacts integrally formed within a lower insulator, each of said lower contacts including a contacting portion exposed outside of the lower insulator in the front-to-back direction;

a metallic shielding plate tightly sandwiched between the upper insulator and the lower insulator in a vertical direction perpendicular to said front-to-back direction;

an insulative upper isolative block being discrete from and located in front of the upper insulator and tightly sandwiched between the contacting portions of the upper contacts and the shielding plate in the vertical direction; and an insulative lower isolative block being discrete from and located in front of the lower insulator and tightly sandwiched between the contacting portions of the lower contacts and the shielding plate in the vertical direction; wherein the upper isolative block is stiffer than the upper insulator and has a higher melting temperature than the upper insulator, and the lower isolative block is stiffer than the lower insulator and has a higher melting temperature than the lower insulator.

8. The electrical connector as claimed in claim 7, wherein the upper isolative block and the lower isolative block are ceramic while the upper insulator and the lower insulator are plastic.

9. The electrical connector as claimed in claim 7, wherein the upper isolative block forms grooves in which the contacting portion of the upper contacts are received, respectively, and the lower isolative block forms grooves in which the contacting portions of the lower contacts are received, respectively.

10. The electrical connector as claimed in claim 7, wherein the shielding plate forms through holes, and the upper isolative block and the lower isolative block form corresponding positioning pillars respectively received within corresponding through holes.

11. The electrical connector as claimed in claim 7, wherein a rear edge of the upper isolative block abuts against a front edge of the upper insulator in the front-to-back direction, and a rear edge of the lower isolative block abuts against a front edge of the lower insulator in the front-to-back direction.

12. The electrical connector as claimed in claim 7, further including a final insulator applied upon both the upper insulator, the upper isolative block, the lower insulator and the lower isolative block so as to efficiently retain the upper insulator, the upper isolative block, the lower insulator and the lower isolative block together.

13. An electrical connector comprising:

a first contact module including a plurality of upper contacts integrally formed within an upper insulator, each of said upper contacts including a contacting portion exposed outside of the upper insulator in a front-to-back direction;

a second contact module including a plurality of lower contacts integrally formed within a lower insulator, each of said lower contacts including a contacting portion exposed outside of the lower insulator in the front-to-back direction;

a metallic shielding plate tightly sandwiched between the upper insulator and the lower insulator in a vertical direction perpendicular to said front-to-back direction;

an insulative upper isolative block being discrete from and located in front of the upper insulator and tightly sandwiched between the contacting portions of the upper contacts and the shielding plate in the vertical direction; and an insulative lower isolative block being discrete from and located in front of the lower insulator and tightly sandwiched between the contacting portions of the lower contacts and the shielding plate in the vertical direction; wherein a rear edge of the upper isolative block abuts against a front edge of the upper insulator in the front-to-back direction, and a rear edge of the lower isolative block abuts against a front edge of the lower insulator in the front-to-back direction.

14. The electrical connector as claimed in claim 13, wherein the upper isolative block and the lower isolative block are ceramic while the upper insulator and the lower insulator are plastic.

15. The electrical connector as claimed in claim 13, wherein the upper isolative block forms grooves in which the contacting portion of the upper contacts are received, respectively, and the lower isolative block forms grooves in which the contacting portions of the lower contacts are received, respectively.

16. The electrical connector as claimed in claim 13, wherein the shielding plate forms plural through holes, and each of the upper isolative block and the lower isolative block forms a positioning pillar received within a corresponding through hole.

17. The electrical connector as claimed in claim 13, further including a final insulator applied upon the upper insulator, the upper isolative block, the lower insulator, and the lower isolative block so as to retain the upper insulator, the upper isolative block, the lower insulator, and the lower isolative block together.

* * * * *